United States Patent [19]

Nagahamaya

[11] Patent Number: 4,781,481

[45] Date of Patent: Nov. 1, 1988

[54] THERMAL PRINTER AND ITS PRINTING METHOD

[75] Inventor: Yuji Nagahamaya, Takizawa, Japan

[73] Assignee: Alps Electric Co., Ltd., Japan

[21] Appl. No.: 86,958

[22] Filed: Aug. 19, 1987

[30] Foreign Application Priority Data

Oct. 28, 1986 [JP] Japan ..... 61-256694
Oct. 28, 1986 [JP] Japan ..... 61-256695

[51] Int. Cl.[4] ..... B41J 3/20

[52] U.S. Cl. ..... 400/697.1; 400/240.1; 400/120

[58] Field of Search ..... 400/120, 696, 240.1; 346/76 PH

[56] References Cited

U.S. PATENT DOCUMENTS

| | | | |
|---|---|---|---|
| 4,384,979 | 5/1983 | Anderson et al. | 400/696 |
| 4,453,839 | 6/1984 | Findlay et al. | 400/240.1 |
| 4,547,088 | 10/1985 | Shatluck | 400/696 |
| 4,651,162 | 3/1987 | Nakamura | 400/696 |
| 4,700,200 | 10/1987 | Hibino | 400/120 |

FOREIGN PATENT DOCUMENTS

| | | | |
|---|---|---|---|
| 3614840 | 11/1986 | Fed. Rep. of Germany | 400/696 |

OTHER PUBLICATIONS

Anderson et al., "Release Adhesive . . . Correction", IBM Technical Disclosure Bulletin, vol. 24, No. 5, p. 2247, 10/81.

*Primary Examiner*—William Pieprz
*Attorney, Agent, or Firm*—Guy W. Shoup; Leighton K. Chong; Paul J. Winters

[57] ABSTRACT

A thermal printer includes a single thermal recording medium interposed between printing paper and a thermal head so that when predetermined energy is applied to the thermal head, colorant on the thermal recording medium is transferred to the paper to print out a desired letter or symbol, or alternatively the printed letter or symbol is removed and erased from the paper because the colorant once transferred to the paper is attached to the colorant on the thermal recording medium. A printing method using the thermal printer is characterized in originally setting printing energy and erasing energy the latter of which is equal to or larger than the former, applying the printing energy to the thermal recording medium to effect printing operation, and applying the erasing energy to the thermal recording medium to attach it to the printed letter or symbol on the paper to remove and erase it from the paper.

4 Claims, 4 Drawing Sheets

THERMAL PRINTER AND ITS PRINTING METHOD

FIELD OF THE INVENTION

This invention relates to a thermal printer and its printing method, and more particularly to an improvement thereof ensuring reliable correction or erasure of letters or symbols thermally printed on a sheet of printing paper.

BACKGROUND OF THE INVENTION

Thermal printers in general use a thermal printing medium such as ink ribbon which has a hot-melt ink layer and is interposed between recording paper and a thermal head, so that the hot-melt ink on the ink ribbon is heated and melted by multiple heater elements attached to the thermal head, to transfer or print desired letters or symbols on the recording paper. Thermal printers have an advantage that the noise produced by the head hitting the paper during printing operation is extremely small than that of other type printers.

The use of thermal printers is today expanded to electronically-controlled typewriters in which correcting function is indispensable to correct letters or symbols once printed on printing paper. In this connection, most typewriters of this type include an erasing ribbon in addition to normal ink ribbon to effect correction by painting the letters to be erased by a colorant of the same color as the recording paper.

However, the use of specific erasing ribbon requires a changeover mechanism to selectively activate the ink ribbon or the erasing ribbon, and this invites a large-scaled and complicated construction of the typewriter. Beside this, since the painted colorant makes an uneven plane on the paper, clear print on the colorant is not expected.

OBJECT OF THE INVENTION

It is therefore an object of the invention to provide a printer and its printing method using a single thermal recording medium to effect both printing operation and correcting operation and thereby ensuring high-quality, uniform printing.

SUMMARY OF THE INVENTION

A thermal printer according to the invention uses a single thermal recording medium opposed to recording paper. The thermal recording medium consists of an ink layer, a separation layer adjacent to the ink layer and a base layer adjacent to the separation layer. The separation layer has the melting or softening point higher than those of the ink layer and has the melting viscosity lower than that of the ink layer.

A printing method effected by the aforegoing thermal printer comprises the steps of originally determining the printing energy and the erasing energy equal to or different from the printing energy, supplying the thermal recording medium with the printing energy during printing operation to perform desired printing on the printing paper, and supplying same with the erasing energy during correcting operation to erase misprint on the paper by adhereing the ink on the paper to the thermal recording medium.

DETAILED DESCRIPTION

Figure 1:
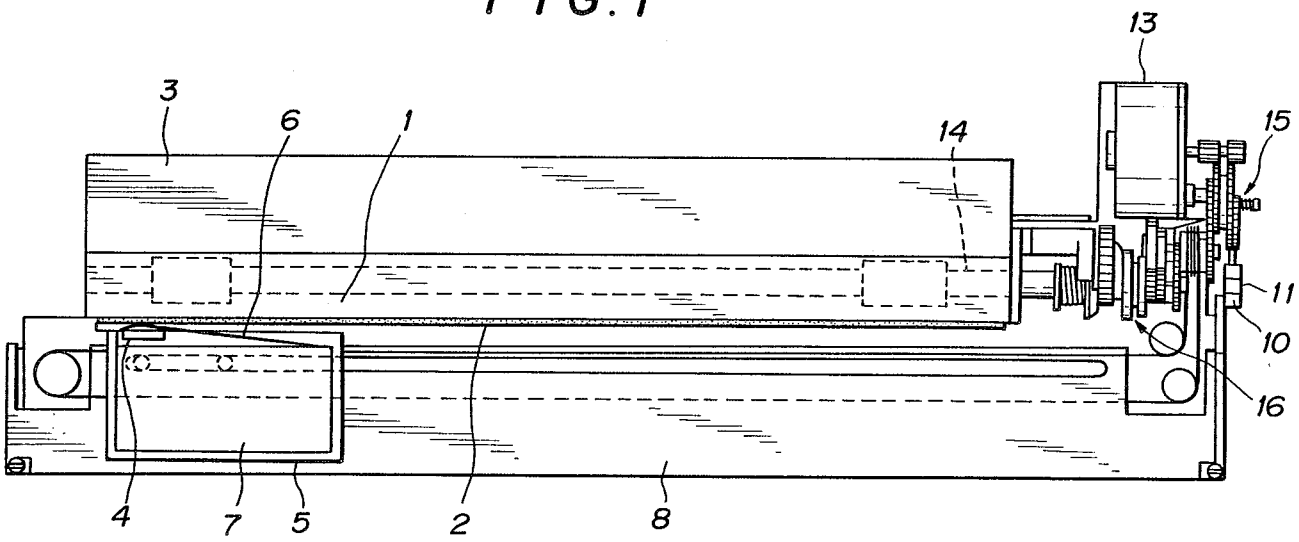
FIG. 1 is a plan view showing a general arrangement of a thermal printer according to a preferred embodiment of the invention.

The invention printer and printing method are described below, referring to a preferred embodiment illustrated in the drawings.

Figure 2A:
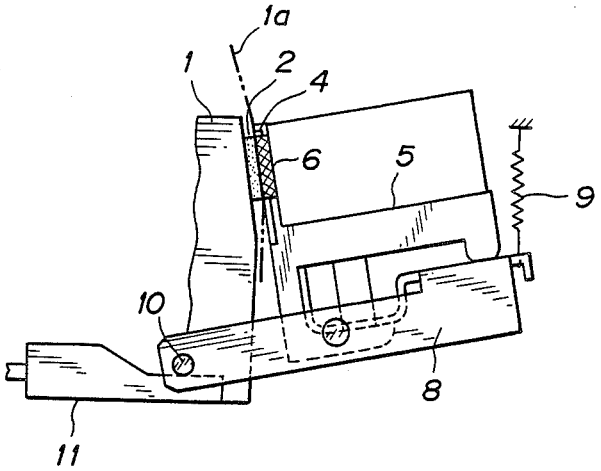
FIGS. 2(*a*) and (*b*) are side elevations showing motions of the arrangement of FIG. 1.
Figure 2B:
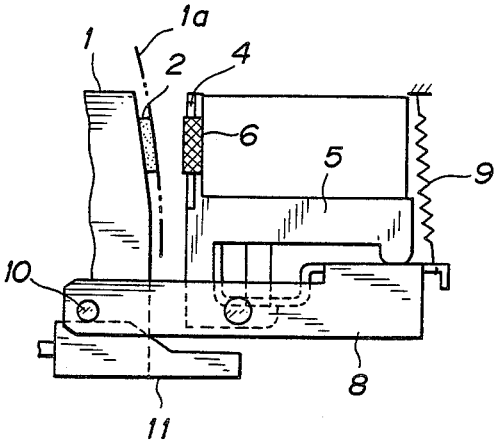

FIG. 1 is a plan view which shows a general construction of a thermal printer according to a first embodiment of the invention, and FIGS. 2(*a*) and (*b*) are side elevations which show different operative configurations of the arrangement of FIG. 1.

In FIG. 1 and FIGS. 2(*a*) and (*b*), reference numeral 1 refers to a platen, 2 to a platen rubber sheet defining the printing position, and 1*a* to a sheet of printing paper supported on the platen 1 and the platen rubber 2. Reference numeral 3 denotes a paper guide which guides the paper 1*a* along the platen rubber 2. Reference numeral 4 designates a thermal head opposed to the platen rubber 2 and includes multiple heater elements. The thermal head 4 is supported on a carriage 5 movable in the right and left direction in FIG. 1 along the platen 1. A thermal recording medium such as printing ribbon 6 which is interposed between the thermal head 4 and the recording paper la and coated by a colorant. The printing ribbon 6 is supported in a ribbon cassette which is put on the carriage 5. The carriage 5 is movably supported on a carriage support member 8 which itself is pivotable with respect to the platen 1 and biased counterclockwisely by a spring 9 as shown in FIG. 2(*a*). The carriage support member 8 is provided with a pin 10 at one end thereof near the platen 1. The pin 10 engages a cam 11.

Still referring to FIG. 1, reference numeral 13 designates a drive source, i.e. a pulse motor. Rotation of the pulse motor 13 is transmitted by a train of gears 15. The rotation of the motor transmitted by the gear train 15 is selectively transmitted by a clutch mechanism to a mechanism for moving the carriage 5 and to a mechanism for rotating a paper feeding shaft 14.

The cam 11 shown in FIGS. 2(*a*) and (*b*) is configured to move to the right and left in the same drawings, in response to rotation of the pulse motor 13.

Figure 3:
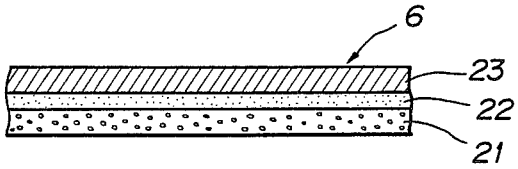
FIG. 3 is a fragmentary, enlarged side elevation showing a general construction of a thermal recording medium embodying the invention and used in the thermal printer of FIG. 1.

The printing ribbon has a general arrangement shown by a fragmentary, enlarged side elevation in FIG. 3. Reference numeral 21 designates an ink layer which is about 1 to 10 μm thick. The ink layer consists of a binder whose major materials are etylene-vinyl acetate copolymer (EVA), ethylene ethyl acrylate copolymer (EEA), polyvinyl alcohol (PVA), etc. and which is mixed with a colorant made from carbon black or other pigment and/or oil black or other dye, as well as preservative, dispersant or other additive. Reference numeral 22 denotes a substantially transparent separation layer which is about 1 to 5 μm thick and adjacent to the ink layer 21. The separation layer 22 consists of low molecular weight polyethylene, paraffin wax, amido wax or other material mixed with oil or other softener. The separation layer 22 has the melting or softening point higher than those of the ink layer 21 and the melting viscosity lower than that of the ink layer 21. Reference numeral 23 denotes a base layer adjacent to the separation layer 22 and made from polyethelene terephtalate (PETP) or other plastic film up to about 3 to 12 μm thick. The ink layer 21 is configured to have the attachment force with the recording paper la larger than the affinity with the separation layer 22 and larger than the cohesion of the separation layer 22 while separation layer 22 is molten or softened. Further, while the separation layer 22 is hardened, the ink layer 21 has the attachment force with the printing paper 1*a* smaller than its affinity with the separation layer 22 and smaller than the cohesion of the separation layer.

Figure 4A:
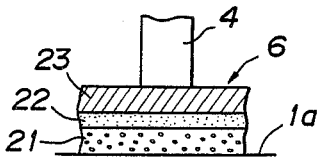
FIGS. 4(*a*) and (*b*) are views for explaining a printing operation effected in the thermal printer of FIG. 1 including the thermal recording medium of FIG. 3.
Figure 4B:
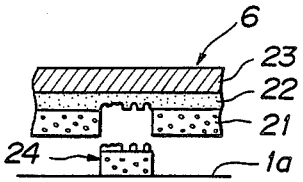

A printing method effected by the thermal printer described above is explained below, also referring to FIGS. 4(*a*), 4(*b*), 5(*a*), 5(*b*) and 5(*c*). FIGS. 4(*a*) and (*b*) are views for explaining a printing operation effected by the thermal printer of FIG. 1, and FIGS. 5(*a*), (*b*) and (*c*) are views for explaining a correcting operation effected by the same thermal printer.

First of all, the pulse motor 13 shown in FIG. 1 is energized to drive the gear train 15 and clutch mechanism 16. Thereby, the paper feeding shaft 14 is rotated to set the paper 1*a* at the printing position. At this time, as shown in FIG. 2(*b*), the pin 10 provided on the carriage support member 8 engages a higher portion of the cam 11 against the energy of the spring 9, so that the thermal head 4 is held apart from the platen rubber 2.

When the pulse motor 13 is activated in this configuration, the cam 11 is moved to the left in FIG. 2(*b*) via the gear train 15 and brings the pin 10 into contact with a lower portion of the cam 11 as shown in FIG. 2(*a*). Due to this, the carriage support member 8 is rotated in the counterclockwise direction so that the thermal head 4 closely contacts the platen rubber 2, sandwiching the paper 1*a* therebetween. Thus the printer is ready for printing operation or erasing (correcting) operation with respect to the paper 1*a*.

To establish the configuration for printing or correcting operation, the clutch mechanism 16 is changed to transmit the rotation of the pulse motor 13 to the carriage moving mechanism via the gear train 15 to move the carriage 5 along the platen rubber 2.

To actually commence a printing operation in the stand-by configuration of FIG. 2(*a*), the printing ribbon 6 is closely urged to the printing paper 1*a*, with its ink layer 21 facing to the paper as shown in FIG. 4(*a*). Subsequently, when printing energy of about 20 to 35 mj/mm$^2$, for example, is applied to the thermal head 4, the ink layer 21 and the separation layer 22 are melted. However, since the melting viscosity of the separation layer 22 is lower than that of the ink layer 21, the separation layer 22 becomes softer. In this configuration, i.e. while the temperature of the printing ribbon 6 is 150 to 250 degrees in this embodiment, when the printing ribbon 6 is stripped from the printing paper 1*a*, surface destruction between the ink layer 21 and the separation layer 22 and cohesive failure of the separation layer 22 are invited so that the ink layer 21 remains on the printing paper 1*a* in the form of a desired print 24 as shown in FIG. 4(*b*).

Figure 5A:
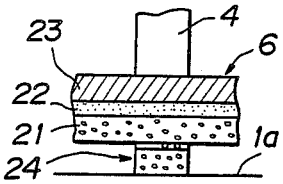
FIGS. 5(*a*), (*b*) and (*c*) are views for explaining correcting operation effected by the same thermal printer.
Figure 5B:
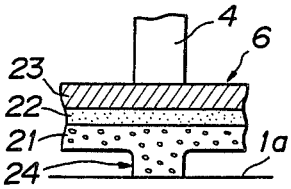
Figure 5C:
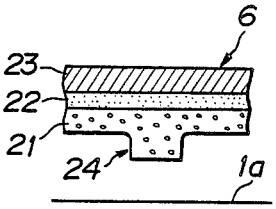

To correct the print 24 on the recording paper 1*a*, the printing ribbon 6 is urged to the print 24 on the printing paper 1*a*, with its ink layer 21 contacting the paper as shown in FIG. 5(*a*). Subsequently, when erasing energy of about 35 to 55 mj/mm$^2$, for example, larger than the printing energy is applied to the thermal head 4, the ink layer 21 and the separation layer 22 are melted over an area larger than that melted in the printing operation. As a result, the melted ink layer 21 is adhered to the print 24 on the paper 1*a* as shown in FIG. 5(*b*). It should be noted here that the same heater elements supplied with erasing energy larger than printing energy never fail to melt the ink layer 21 wider than the melted area in the printing operation so as to completely cover the print 24 on the paper 1*a*. After this, when the energy is removed, the temperature of the printing ribbon 6 drops below the melting point of the separation layer 22, and the layer is hardened. In this configuration, when the printing ribbon 6 is stripped from the printing paper 1*a*, the print 24 on the paper 1*a* is removed from the paper 1*a* together with the printing ribbon 6. Then the erasing operation is completed.

In the aforegoing erasing operation, the print 24 can be completely removed from the paper 1*a* by simply energizing limited ones of the heater elements of the thermal head 4 in the form of the print 24. However, the same effect can be obtained by energizing all the heater elements 24.

Figure 6:
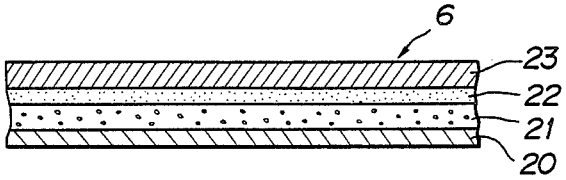
FIG. 6 is a fragmentary, enlarged side elevation showing a general arrangement of a thermal recording medium according to a second embodiment of the invention and used in the thermal printer in FIG. 1.

A general arrangement of the printing ribbon 6 according to a second embodiment of the invention is explained below, referring to a fragmentary enlarged side elevation of FIG. 6. Reference numeral 20 designates a top coat layer which is substantially transparent and about 1 to 5 μm thick. The top coat layer 20 consists of a binder whose major materials are etylene-vinyl acetate copolymer (EVA), ethylene ethyl acrylate copolymer (EEA), polyvinyl alcohol (PVA), etc. mixed with preservative, dispersant or other additive. Reference numeral 21 denotes an ink layer which is continuous from the top coat layer 20 and 1 to 10 μm thick. The ink layer 21 consists of the same materials of the top coat layer 20 mixed with a colorant made from carbon black or other pigment and/or oil black or other dye. The ink layer 21 has the melting or softening point and the melting viscosity substantially equal to those of the top coat layer 20. Reference numeral 22 denotes a substantially transparent separation layer which is about 1 to 5 μm thick and adjacent to the ink layer 21. The separation layer 22 consists of low molecular weight polyethylene, paraffin wax, amido wax or other material mixed with oil or other softner. The separation layer 22 has the melting or softening point higher than those of the ink layer 21 and the melting viscosity lower than that of the ink layer 21. Reference numeral 23 denotes a base layer adjacent to the separation layer 22 and made from polyethelene terephtalate (PETP) or other plastic film up to about 3 to 12 μm thick. The top coat layer 20 and the ink layer 21 are always united together, and they are attached or removed together with respect to the printing paper la in printing or erasing operation. While the separation layer 22 is melted or softened, the top coat layer 20 has the attachment force with the printing paper 1*a* larger than the affinity between the ink layer 21 and the separation layer 22 and larger than the cohesion of the separation layer 22. While the separation layer 22 is hardened, however, the affinity between the ink layer 21 and the separation layer 22 and the cohesion of the separation layer 22 are larger than the attachment force between the top coat layer 20 and the printing paper 1*a*.

Figure 7A:
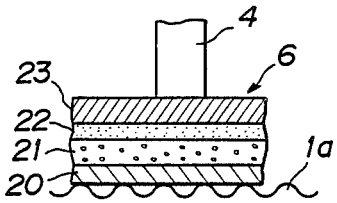
FIGS. 7(*a*) and (*b*) are views for explaining a printing operation effected in the thermal printer of FIG. 1 using the thermal recording medium according to the second embodiment of the invention.
Figure 7B:
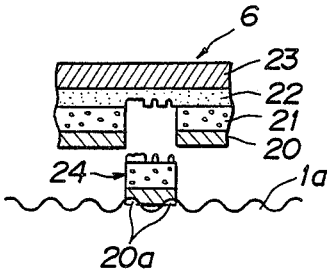

A printing method effected by the aforegoing thermal printer using the printing ribbon 6 according to the second embodiment is explained below, also referring to FIGS. 7(*a*), 7(*b*), 8(*a*), 8(*b*) and 8(*c*). FIGS. 7(*a*) and (*b*) are views for explaining a printing operation effected by the thermal printer of FIG. 1, and FIGS. 8(*a*), (*b*) and (*c*) are views for explaining a correcting operation effected by the same thermal printer.

First of all, the pulse motor 13 shown in FIG. 1 is energized to drive the gear train 15 and clutch mechanism 16. Thereby the paper feeding shaft 14 is rotated to set the paper la at the printing position. At this time, as shown in FIG. 2(*b*), the pin 10 provided on the carriage support member 8 engages a higher portion of the cam 11 against the energy of the spring 9, so that the thermal head 4 is held apart from the platen rubber 2.

When the pulse motor 13 is activated in this configuration, the cam 11 is moved to the left in FIG. 2(*b*) via the gear train 15 and brings the pin 10 into contact with a lower portion of the cam 11 as shown in FIG. 2(*a*). Due to this, the carriage support member 8 is rotated in the counterclockwise direction so that the thermal head 4 closely contacts the platen rubber 2, sandwiching the paper 1*a* therebetween. Thus the printer is ready for printing operation or erasing (correcting) operation with respect to the paper 1*a*.

To establish the configuration for printing or correcting operation, the clutch mechanism 16 is changed to transmit the rotation of the pulse motor 13 to the carriage moving mechanism via the gear train 15 to move the carriage 5 along the platen rubber 2.

To actually commence a printing operation in the stand-by configuration of FIG. 2(*a*), the printing ribbon 6 is closely urged to the printing paper 1*a*, with its top coat layer 20 facing to the paper as shown in FIG. 7(*a*). Subsequently, when printing energy of about 30 to 45 mj/mm$^2$, for example, is applied to the thermal head 4, the top coat layer 20, ink layer 21 and separation layer 22 are melted. However, since the melting viscosity of the separation layer 22 is lower than that of the top coat layer 20 and ink layer 21, the separation layer 22 becomes softer. In this configuration, i.e. while the temperature of the printing ribbon 6 is 150 to 250 degrees in this embodiment, when the printing ribbon 6 is stripped from the printing paper 1*a*, surface destruction between the ink layer 21 and the separation layer 22 and cohesive failure of the separation layer 22 are invited so that the top coat layer 20 and the ink layer 21 remain on the printing paper 1*a* in the form of a desired print 24 as shown in FIG. 7(*b*). In this case, part 20*a* of the top coal layer 20 soaks into the printing paper 1*a* if the paper surface is rough.

Figure 8A:
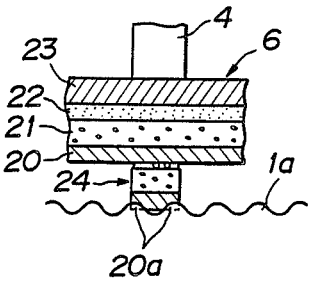
FIGS. 8(*a*), (*b*) and (*c*) are views for explaining a correcting operation effected by the same thermal printer.
Figure 8B:
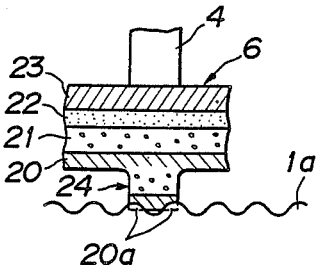
Figure 8C:
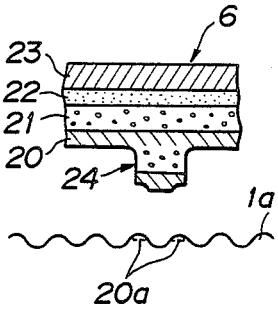

To correct the print 24 on the printing paper 1*a*, the printing ribbon 6 is urged to the print 24 on the printing paper 1*a*, with its top coat layer 20 contacting the paper 1*a* as shown in FIG. 8(*a*). Subsequently, when erasing energy equal to the printing energy is applied to the thermal head 4, the top coat layer 20, ink layer 21 and separation layer 22 are melted. As a result, the melted top coat layer 20 and ink layer 21 are adhered to the print 24 on the paper 1*a* as shown in FIG. 8(*b*). After this, when the energy is removed, the temperature of the printing ribbon 6 drops below the melting point of the separation layer 22, and the layer is hardened. In this configuration, when the printing ribbon 6 is stripped from the printing paper 1*a*, the print 24 on the paper la is removed from the paper 1*a* together with the printing ribbon 6. Then the erasing operation is completed. In this case, the part 20*a* of the top coat layer 20 remains in the paper 1*a*. However, since the top coat layer 20 is transparent, it is hardly visible.

If the device is configured to memorize the print 24 to be corrected, only limited ones of the heater elements of the thermal head 4 in the form of the print 24 may be energized. In this case, however, it is necessary to apply larger energy of about 45 to 65 mj/mm$^2$ to the printing ribbon 6 to melt the top coat layer 20 and ink layer 21 over an area larger than that melted in the printing operation so that the print 24 on the paper la is completely covered.

If the device has no means to memorize the print 24 to be corrected, all the heater elements of the thermal head 4 must be energized. In this case, however, since it is not necessary to melt the top coat layer 20 and ink layer 21 over an area larger than that melted in the printing operation, erasing energy to the printing ribbon 6 may be reduced to 10 to 30 mj/mm$^2$, for example, which is smaller than the printing energy.

Any artisan in this field will understand that the invention is not limited to the described embodiments, and that various changes or modifications may be employed without departing from the scope of the invention.

The above-described thermal printer and its printing method uses a single thermal recording medium to effect both printing and correcting operation. Therefore, the structure of the thermal printer can be simplified and small-scaled.

Additionally, the specific use of the substantially transparent top coat layer having a high melting viscosity improves the quality of print on rough printing paper, and part of the top coat layer, although remaining in the printing paper after erasure, is never visible.

What is claimed is:

1. In a thermal printer having a thermal recording medium interposed between a recording paper and a thermal head, said thermal head being operated to apply thermal energy to said recording medium so as to thermally transfer a portion of an ink layer of said recording medium, said ink layer being made of a thremoplastic material and having a colorant, to the recording paper for printing and also being operating for lifting off a previously printed mark of the ink layer from the recording paper for erasing, said printed mark comprising a thermally transferred portion of said ink layer of said thermal recording medium, an improved thermal recording medium comprising:

a base layer to which thermal energy from the thermal head is applied for printing and for erasing;

an ink layer having a predetermined melting temperature and melting viscosity; and a separation layer joining said ink layer to said base layer and having a melting temperature higher than that of said ink layer and a melting viscosity lower than that of said ink layer, wherein, when thermal energy is applied for printing and said separation and ink layers become melted, said melted ink layer has an affinity for the recording paper higher than for said melted separation layer and higher than the cohesion of said separation layer, and when thermal energy is applied for erasing a printed mark on the recording paper, said separation and ink layers become melted and said melted ink layer adheres to the printed mark, and when the thermal energy for erasing is subsequently removed, said separation layer of said thermal recording medium becomes hardened more quickly than said ink layer and said ink layer has an affinity for the recording paper lower than for said hardened separation layer and lower than the cohesion of said separation layer, to thereby lift off the printed mark from the recording paper.

2. A thermal printer of claim 1 wherein said thermal recording medium includes a substantially transparent top coat layer provided on said ink layer.

3. A printed method using a thermal printer having a thermal recording medium interposed between a recording paper and a thermal head, said thermal head being operated to apply thermal energy to said recording medium so as to thermally transfer a portion of an ink layer of said recording medium, said ink layer being made of a thermoplastic material and having a colorant, to the recording paper for printing and also being operated for lifting off a previously printed mark of the ink layer from the recording paper for erasing, said printed mark comprising a thermally transferred portion of said ink layer of said thermal recording medium, wherein the improvement comprises:

providing a thermal recording medium having a base layer to which thermal energy from the thermal head is applied for printing and for erasing, an ink layer having a predetermined melting temperature and melting viscosity, and a separation layer joining said ink layer to said base layer and having a melting temperature higher than that of ink layer and a melting viscosity lower than that of said ink layer, applying thermal energy for printing such that said separation and ink layers become melted, and said melted ink layer has an affinity for the recording paper higher than for said melted separation layer and higher than the cohesion of said separation layer, and applying thermal energy for erasing which is equal to or larger than the printing energy such that said separation and ink layers becomes melted and said melted ink layer adheres to the printed mark, and when the thermal energy for erasing is subsequently removed, said separation layer becomes hardened more quickly than said ink layer and said ink layer has an affinity for the recording paper lower than for said hardened separation layer and lower than the cohesion of said separation layer, to thereby lift off the printed mark from the recording paper.

4. A printing method of claim 3 wherein said thermal recording medium includes a substantially transparent top coat layer provided on said ink layer.

* * * * *